US009205551B2

(12) United States Patent
Green et al.

(10) Patent No.: US 9,205,551 B2
(45) Date of Patent: Dec. 8, 2015

(54) STORAGE TOTE

(71) Applicants: Matthew C. Green, Amherst, MA (US); Peter Weremchuk, Simsbury, CT (US)

(72) Inventors: Matthew C. Green, Amherst, MA (US); Peter Weremchuk, Simsbury, CT (US)

(73) Assignee: Irwin Industrial Tool Company, Huntersville, NC (US)

( * ) Notice: Subject to any disclaimer, the term of this patent is extended or adjusted under 35 U.S.C. 154(b) by 0 days.

(21) Appl. No.: 14/211,870

(22) Filed: Mar. 14, 2014

(65) Prior Publication Data

US 2014/0262885 A1 Sep. 18, 2014

Related U.S. Application Data

(60) Provisional application No. 61/790,495, filed on Mar. 15, 2013.

(51) Int. Cl.

| | |
|---|---|
| ***B25H 3/02*** | (2006.01) |
| ***B65D 25/28*** | (2006.01) |
| *B65D 21/02* | (2006.01) |
| *B65D 25/32* | (2006.01) |
| *B65D 43/16* | (2006.01) |

(52) U.S. Cl.

CPC ..... *B25H 3/02* (2013.01); *B65D 25/2855* (2013.01); *B65D 21/0219* (2013.01); *B65D 25/32* (2013.01); *B65D 43/165* (2013.01); *B65D 2251/1083* (2013.01); *B65D 2525/287* (2013.01); *B65D 2525/288* (2013.01)

(58) Field of Classification Search

CPC ..... B65D 2525/286–2525/288; B65D 2251/1083; B65D 2543/00731; B65D 2543/00768

USPC ..... 206/372, 373; 220/810, 822, 826, 754, 220/761–765, 769, 773, 775, 776, 770; 224/600, 605

See application file for complete search history.

(56) References Cited

U.S. PATENT DOCUMENTS

| | | | | | |
|---|---|---|---|---|---|
| 520,505 | A * | 5/1894 | Upton | 222/111 |
| 2,414,708 | A * | 1/1947 | Bassichis | 206/174 |
| 4,161,261 | A * | 7/1979 | Frater | 220/826 |
| 4,365,725 | A * | 12/1982 | Pfeifer | 220/762 |
| 4,714,158 | A * | 12/1987 | Oltman et al. | 206/349 |
| 4,720,021 | A * | 1/1988 | Byrns | 220/764 |
| 4,997,090 | A * | 3/1991 | Lenmark et al. | 206/570 |
| 5,011,013 | A * | 4/1991 | Meisner et al. | 206/373 |
| 5,353,948 | A * | 10/1994 | Lanoue et al. | 220/826 |
| 5,967,322 | A * | 10/1999 | Apps et al. | 206/497 |
| 7,780,036 | B2 * | 8/2010 | Splain | A45C 3/04 206/505 |

* cited by examiner

*Primary Examiner* — Anthony Stashick
*Assistant Examiner* — Mollie Llewellyn
(74) *Attorney, Agent, or Firm* — Sutherland Asbill & Brennan LLP

(57) ABSTRACT

A device for storage and transfer of tools and supplies that includes a housing, a cover and a handle. The housing defines a storage area therein and is configured to receive a plurality of tools and supplies. The cover is pivotally attached to the housing and is movable between a closed position covering the storage area and any tools and supplies therein, and an open position at least partially exposing and permitting access to the storage area and any tools and supplies therein. The handle is pivotally attached to the housing and is movable between a storage position located within the housing and a use position projecting from the housing for carrying the device thereby. The cover is movable between the closed and open positions while the handle is either in the storage position or the use position.

19 Claims, 7 Drawing Sheets

STORAGE TOTE

CROSS-REFERENCE TO RELATED APPLICATIONS

This application claims the benefit under 35 U.S.C. §119 to similarly-titled U.S. Provisional Patent Application No. 61/790,495, filed Mar. 15, 2014, which is hereby expressly incorporated by reference in its entirety as part of the present disclosure.

FIELD OF THE INVENTION

The present invention relates to totes, and more particularly to totes for the storage and transport of tools and supplies.

BACKGROUND OF THE INVENTION

On-site service technicians generally carry storage belts, bags, and/or trays for storing and transporting tools often used throughout the work day. Such a storage and transport device aids a technician in both transporting such tools between work sites, as well as having the tools readily accessible when needed.

One drawback associated with known storage trays, however, is that they do not have covers/lids and thus are exposed at the top. Consequently, tools stored therein can fall out during transport. Similarly, where liquid is in the tray, the liquid may spill out during transport. Additionally, the contents stored within the tray are not protected from the outside environment, such as, for example, from wind, rain or snow.

Another drawback associated with known trays is that they are not easily stackable. This is due, in part, to a handle fixedly protruding from the tray. Accordingly, it is generally challenging for a technician to store multiple trays in a limited spaced, such as for example, in the trunk of a car or van. Additionally, the poor stackability of known trays makes it more difficult to transport multiple trays together, and often requires carrying each tray with one hand or carrying trays one by one.

SUMMARY OF THE INVENTION

It is an object of the present invention to overcome one or more of the above-described drawbacks and/or disadvantages of the prior art.

In accordance with one aspect, a storage tote for storage and transfer of tools and supplies comprises a housing defining a storage area therein and configured to receive a plurality of tools and supplies, a cover pivotally attached to the housing, movable between a closed position covering the storage area and any tools and supplies therein, and an open position at least partially exposing and permitting access to the storage area and any tools and supplies therein, and a handle pivotally attached to the housing, movable between a storage position located within the housing and a use position projecting from the housing for carrying the device thereby. The cover is movable between the closed and open positions while the handle is either in the storage position or the use position. In some embodiments, the device includes a shoulder strap that is releasably attached to the housing.

In some embodiments, the cover comprises a first lid that is pivotally connected to a first wall of the housing, and a second counterpart lid that is pivotally connected to a second wall of the housing opposing the first wall, with the first and second lids being independently movable between the closed and open positions. In other embodiments, the cover defines a substantially flat upper surface of the device when in the closed position. In yet other embodiments, the cover covers the handle when the handle is in the storage position and the cover is in the closed position. In some embodiments, in the use position, the handle is moveable between a locked position, where the handle and housing are substantially not pivotal relative to each other, and an unlocked position, where the handle and housing are pivotal relative to each other.

One advantage of the present invention is that the cover or lid aids in protecting the tools and/or supplies stored within the housing from the external environment and weather conditions and aids in preventing tools and/or supplies stored within the housing of the tote from falling out. Another advantage is that the handle is moveable between storage and use positions. When the handle is in the storage position and the cover is closed, and the tote defines a substantially flat top surface, a tool, an object, or another tote can be stacked on top without interference from the handle. This aids in compact storage and transport of multiple totes.

In yet other advantageous embodiments, the cover includes tabs projecting from the lids. The tabs are positioned inwardly from an upper rim on the lids in order to fittingly engage the bottom portions of the sidewalls of another tote stacked thereon. The tabs stabilize the stacked tote and assist in preventing relative lateral movement between the totes during transport. Further, the tabs keep stacked totes centered on top of one another to help preventing tipping of a stack of totes.

In embodiments having a shoulder strap, this advantageously allows for "hands-free" carrying of the tote(s). More than one tote can be carried at a time when a strap is connected to a lowermost tote, and other totes are stacked thereon.

Objects and advantages of the present invention will become more readily apparent in view of the following description and accompanying drawings.

DETAILED DESCRIPTION OF EMBODIMENTS OF THE INVENTION

Figure 1:
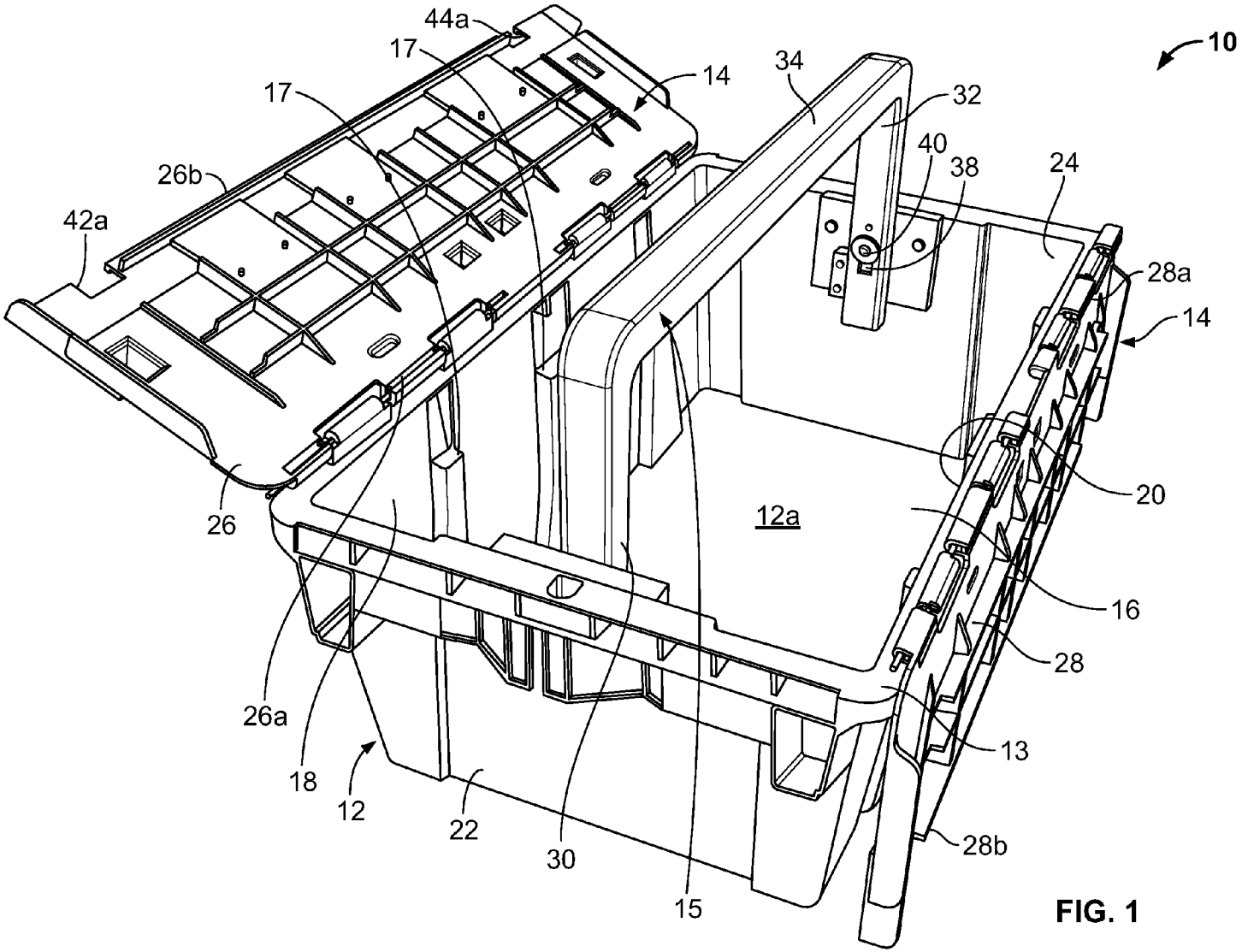
FIG. 1 is a perspective view of a device for storing and transporting tools and supplies, with the cover open and a handle thereof in a use position.

In the figures, a storage and transport device is indicated generally by the reference numeral 10. In the illustrated embodiment, the device 10 is a tote or tray for storage and transport of tools and/or supplies. The tote 10 includes a tote housing 12, defining a storage area 12*a*, a tote cover/lid 14 covering the storage area 12*a*, and a handle 15 for carrying the tote 10. In some embodiments, the tote 10 is made of a plastic resin or composite material. In some such embodiments, the tote 10 is formed by an injection molding process of the material. However, as should be understood by those of ordinary skill in the pertinent art the tote can be made by any of numerous different materials according to the intended function, and can be manufactured in many of numerous different manners currently known or that later becomes known.

The tote housing 12 comprises a substantially flat base 16, opposing front and rear walls 18, 20 extending upward from respective opposing front and rear edges of the base 16, and opposing first and second side walls 22, 24 extending upward from respective opposing first and second side edges of the base 16, between the front and rear walls 18, 20. The base 16 and the walls 18, 20, 22, 24 are joined to each other and define the storage area 12*a*. The upper ends of the walls 18, 20, 22, 24 define a rim 13, substantially flat in the illustrated embodiment, extending substantially continuously around the top of the housing 12. The walls 18, 20, 22, 24 extend upward from the base 16 at a slightly obtuse angle (greater than 90 degrees), such that the perimeter of the rim 13 is slightly larger than the perimeter of the base 16, as explained further below. That is, the housing 12 tapers outwardly from the base 16 to the rim 13.

In the illustrated embodiment, the tote cover 14 comprises first and second folding, and counterpart, lids 26, 28. The first folding lid 26 is pivotally attached, at an outer edge 26*a* thereof, to the upper end of the front wall 18, and the second folding lid 28 is pivotally attached, at an outer edge thereof 28*a*, to the upper end of the rear wall 20. Each lid 26, 28, defines a respective width $W_{26}$, $W_{28}$, that is approximately half the width W defined between the respective upper ends the front and rear walls 18, 20.

Figure 3:
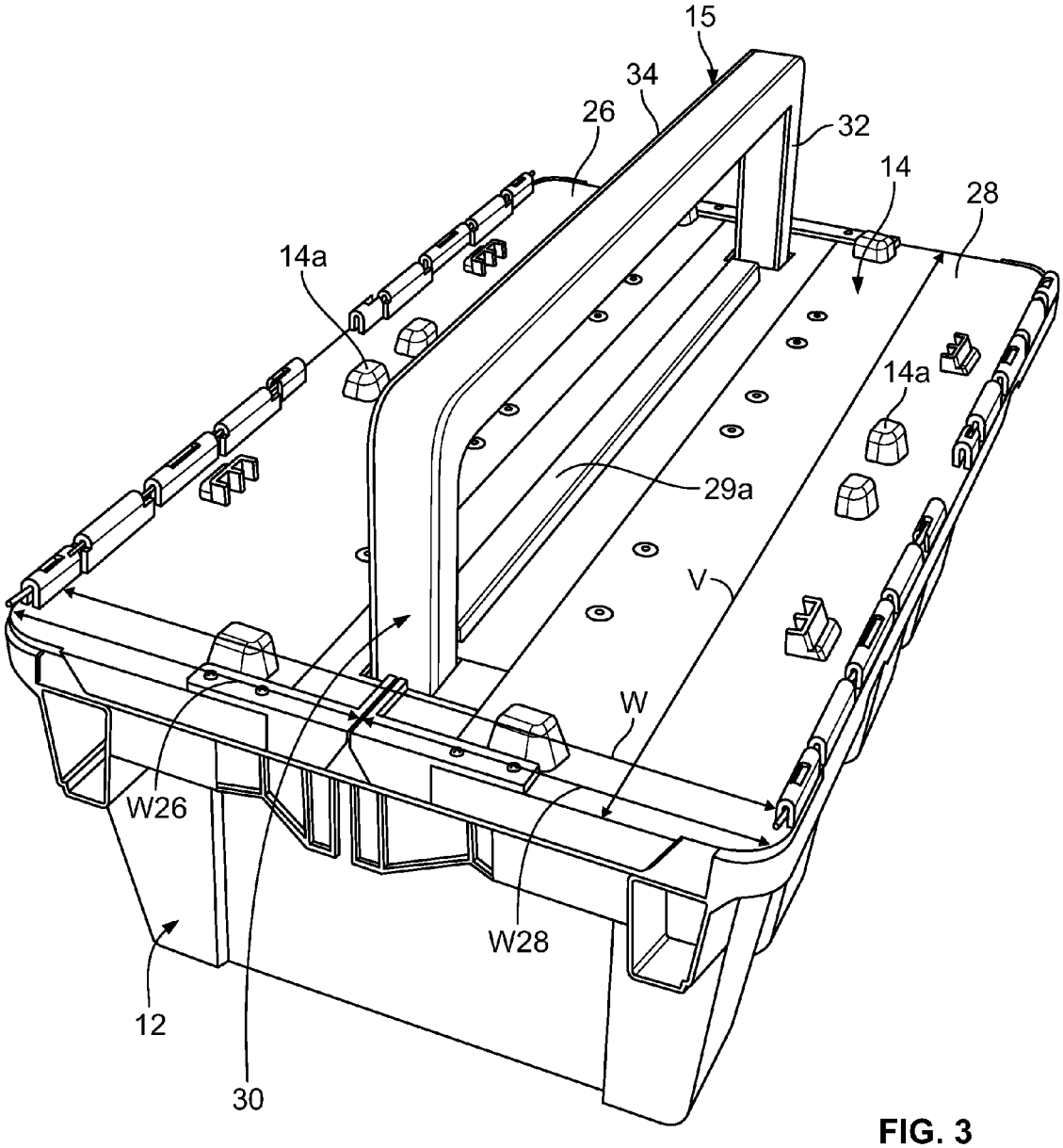
FIG. 3 is a perspective view of the device of FIG. 1, with the cover in the closed position and the handle in the use position.
Figure 4:
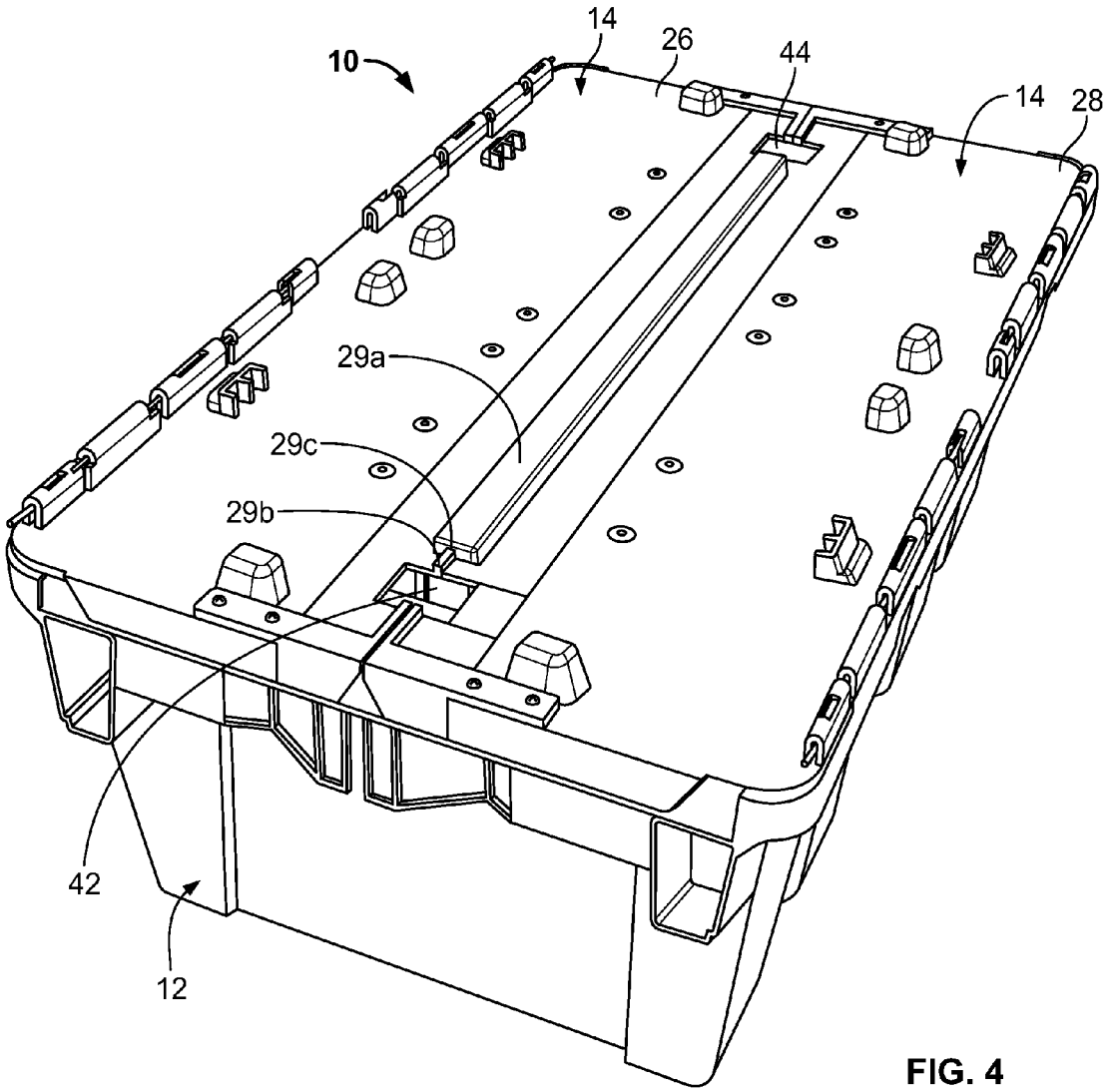
FIG. 4 is a perspective view of the device of FIG. 1, with the handle in the storage position and the cover in the use position.

The first and second folding lids 26, 28 can pivot toward one another into a closed position where side edges of the lids 26, 28 engage or rest substantially flat on the rim 13 of the housing 12 to cover the storage area 12*a*, as shown in FIGS. 3 and 4. The rim 13 at least partially supports the lids 26, 28 when resting thereon. The tote 10 defines a substantially flat top when the lids 26, 28 are in the closed position. In the closed position, the respective inner edges 26*b*, 28*b*, of the first and second lids 26, 28 fit substantially adjacent and flush with one another to substantially eliminate any gap where the lids 26, 28 adjoin. As should be understood by those of ordinary skill in the pertinent art, the material and dimensions of the cover 14 are engineered to substantially support the weight of the cover 14 and mitigate sagging or collapsing thereof when in the closed position. In some embodiments, the cover 14 is designed to support additional weight such as when objects are placed on top of the cover 14.

In the illustrated embodiment, see FIG. 4 for example, the lid 28 includes an elongated strip 29*a* projecting therefrom configured to overlap an elongated lip 29*b* projecting from the lid 26 when the lids 26, 28 are pivoted into the closed position. The elongated lip 29*b* projects from the lid 26 adjacent the inner edge 26*b* thereof. The strip 29*a* extends along the inner edge 28*b* of the lid 28 and projects therefrom. The projecting portion of the strip 29*a* defines a channel 29*c* along the underside thereof for at least partially receiving the lip 29*b* when the lids 26, 28 are in the closed position. The strip 29*a* covers the seam between the lids 26, 28 at its location. The strip 29*a* and the lip 29*b* also mitigate sagging and/or collapsing of the cover 14 when the lids 26, 28 are in the closed position or when objects (such as another tote) are placed on top of the cover 14. As should be understood by those of ordinary skill in the art, the strip 29*a* can be removably or non-removably secured to the lid 28 in any of numerous ways, such as, for example, via screws, pins, etc. Alternatively, the strip 29*a* can be integrally formed with the lid 28 in embodiments where the tote 10 is injection molded. Further, the strip 29*a* may equally be attached to the lid 26 with the lip 29*b* projecting from the lid 28.

Figure 2:
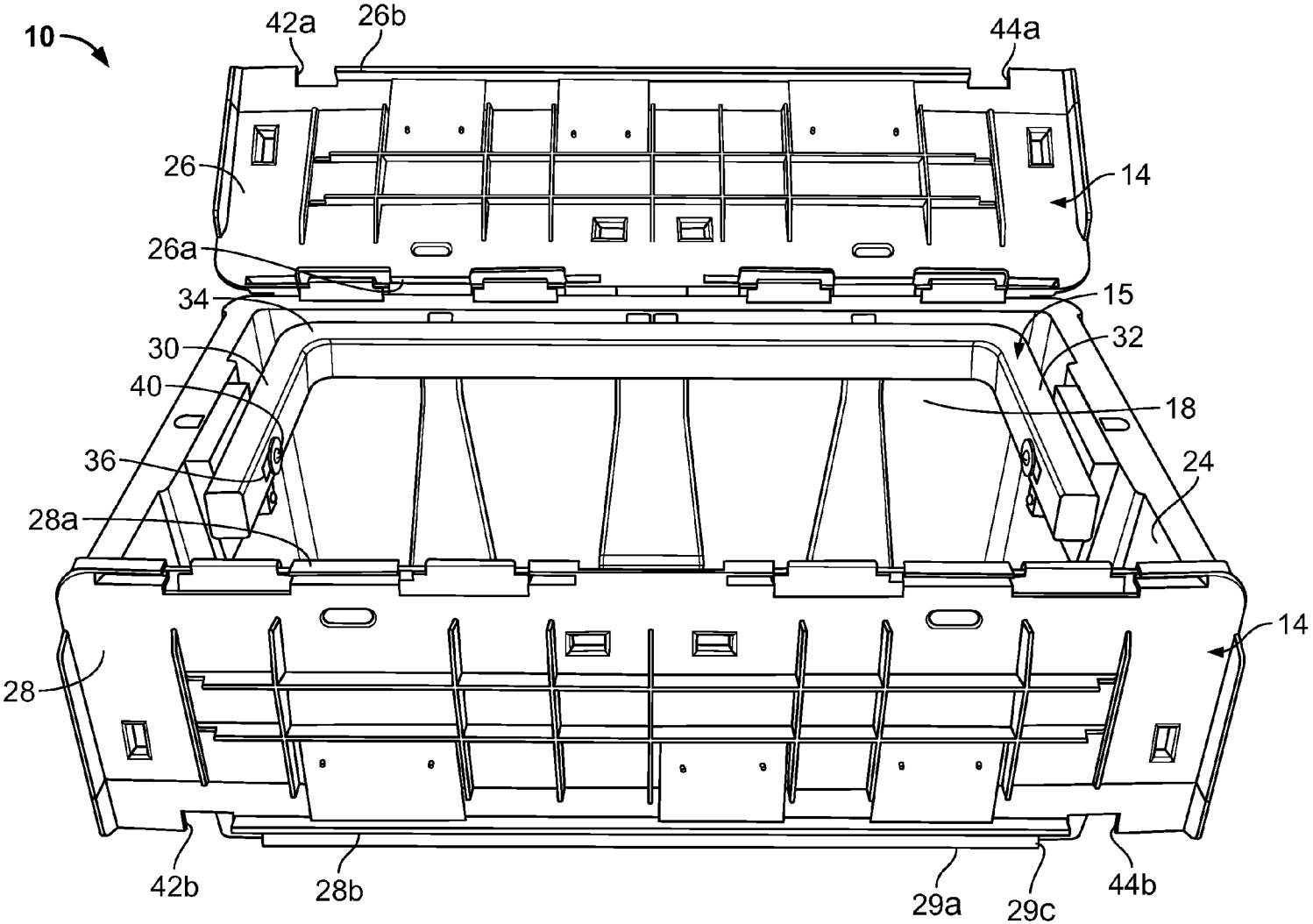
FIG. 2 is a perspective side view of the device of FIG. 1, with the cover open and the handle in the storage position.

The lids 26, 28 can also pivot away from one another into an open position uncovering and permitting access to the storage area 12*a*. In the illustrated embodiment, the lids 26, 28 can pivot at least 270° from the closed position so that, in open position, each lid 26, 28 extends substantially vertically from the respective pivot joint so as to be substantially adjacent to the exterior side of the respective front and rear wall 18, 20, as shown in FIGS. 1 and 2. In such embodiments, the lids 26, 28 when in the open position minimally protrude out from the tote 10 so as to remain out of the way.

As should be understood by those of ordinary skill in the pertinent art, either of the two lids 26, 28 can be in an open position while the other of the two lids is in the closed position, and vice versa. As also should be understood by those of ordinary skill in the art, the first and second folding lids 26, 28 may alternatively be pivotally attached to the first and second side walls 22, 24, such that each lid extends approximately half the length L of the housing 12. As another alternative, the cover 14 may define a single cover pivotally attached to either of the front or real walls 18, 20, and extending the entire width W of the housing 12, or a single cover attached to either of the first or second side walls 22, 24, and extending the entire length L of the housing 12.

The handle 15 comprises first and second side arms 30, 32 joined to an elongate upper arm 34 extending therebetween. In the illustrated embodiment, the handle 15 is a folding handle pivotally attached to the first and second side walls 22, 24, via the first and second side arms 30, 32, respectively. However, as should be understood by those of ordinary skill in the pertinent art, the handle 15 may alternatively be pivotally attached to the front and rear walls 18, 20. The handle 15 is pivotal between a storage position, as shown in FIG. 1, and a use position, as shown in FIG. 2. In the storage position, the handle 15 is oriented in a substantially horizontal orientation within the housing 12. The handle 15 can pivot toward the front and/or real walls 18, 20 to fold into the storage position, though in other embodiments the handle may pivot in only one direction. The front and/or rear walls 18, 20 include projections 17 on the interior surface(s) thereof upon which the handle arm 34 engages or rests when folded into the storage position, such that the handle 15 is maintained oriented substantially parallel to the base 16. The pivot points of the handle 15 on the side walls 22, 24 are spaced sufficiently below the upper rim 13 of the housing 12 such that the handle 15 does not project above the upper rim 13 of the housing 12 when pivoted into the storage position. That is, the handle 15 is located entirely in the storage area in the storage position. Accordingly, when in the storage position, the handle 15 does not interfere with closing of the lids 26, 28, i.e., lying flat on the rim 13. In the use position, the handle 15 is oriented in a substantially upright orientation, substantially perpendicular to the base 16, extending out of the housing 12. In some embodiments, the handle arm 30 and housing side wall 22, and the handle arm 32 and housing side wall 24, form respective detent mechanisms (not shown) therebetween. The detent mechanisms are engaged when the handle 15 is moved into the use position to such that the handle 15 remains upright. The detent mechanisms are disengaged when the handle 15 is moved back into the storage position. When the handle is in the use position, a user can carry the tote 10 therefrom.

Figure 7:
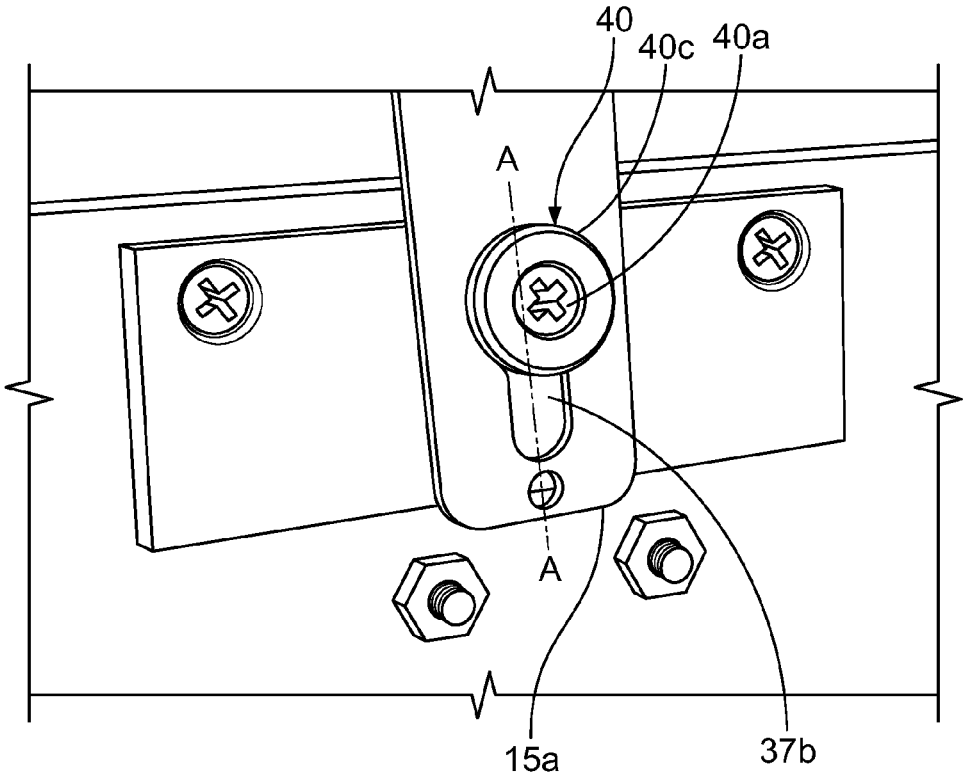
FIG. 7 is a close-up view of the connection of the handle to the housing in an embodiment with the handle side arm in a first unlocked position.
Figure 8:
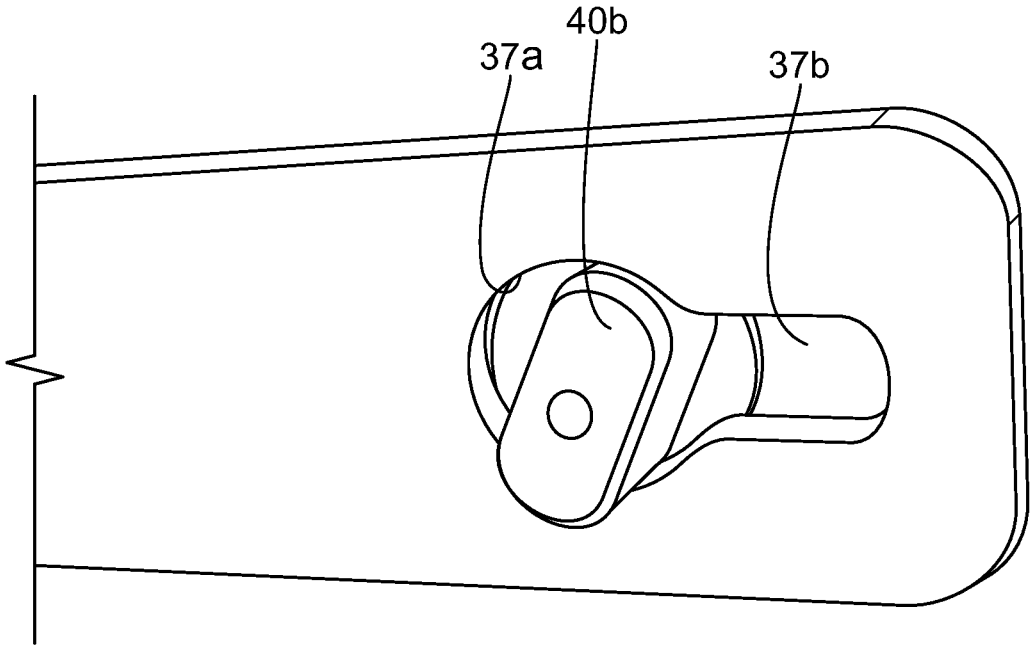
FIG. 8 is a rear view of the handle and fastening member of FIG. 7 disassembled from the housing.
Figure 9:
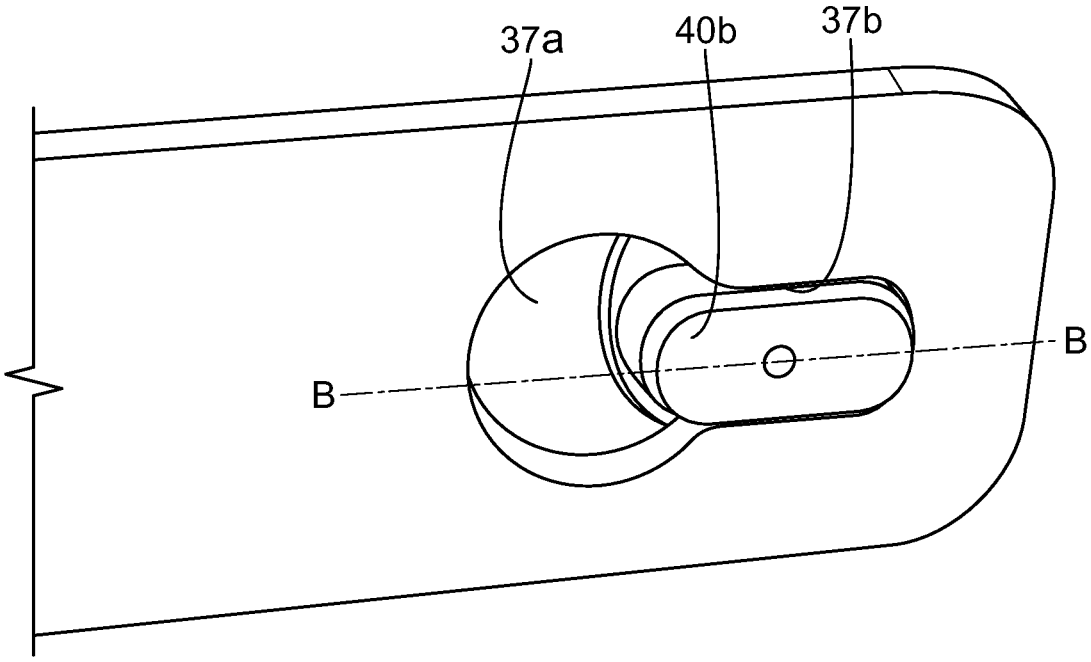
FIG. 9 is a rear view of the handle and fastening member of FIG. 8 with the fastening member moved into a locking position of the handle.

In the illustrated embodiment, the handle 15 can also be locked into the use position, in order to reduce pivoting or swaying of the housing 12 relative to the handle 15. In the illustrated embodiment, the first and second side arms 30, 32 include respective first and second slots 36, 38, and the handle 15 is pivotally attached to the housing 12 via fastening members 40 extending through the respective first and second slots 36, 38 and into the respective side walls 22, 24. As shown in FIGS. 7-9, each fastening member 40 includes a first portion 40*c* that is larger than the slots 36, 38 and engages an inner surface of the handle side arms 30, 32 (the surface facing the storage area 12*a*) to retain the handle 15 to the housing 12. The fastening members 40 also each include an elongate stopper 40*b* extending from the first portion 40*c* that is shaped and dimensioned, in conjunction with the shape and dimensions of the slots 36, 38, to extend through the slots 36, 38 and allow the handle 15 to pivot and lock as described below. The slots 36, 38 have a first portion 37*a* shaped and dimensioned such that when the handle 15 is positioned so that the fastening members 40 are located within and extend through the first portion 37*a* of the slots 36, 38 (FIGS. 7, 8), the handle 15 and fastening member 40 can rotate relative to each other. The slots 36, 38 have a second portion 37*b* contiguous with the first portion 37*a* and located toward the end 15*a* of the handle 15. The second portion 37*b* of the slots 36, 38 are shaped and dimensioned such that when the handle 15 is positioned so that the fastening members 40 are located within and extend through the second portion 37*b* of the slots 36, 38 (FIG. 9), the handle 15 and the slots 36, 38 are substantially prevented from rotating relative to each other. In the illustrated embodiment, the fastening members 40 comprise respective screws 40*a* secured within respective elongate stoppers 40*b* that attach the fastening members 40 in fixed position to the housing 12. Accordingly, the handle 15 pivots about the fastening member 40 between the storage and use positions.

As shown, the first portions 37*a* of the slots 36, 38 are circular and dimensioned so that the handle 15 is rotatable about the elongate stoppers 40*b*. The second portions 37*b* are elongate and dimensioned to substantially fittingly receive the elongate stoppers 40*b*, and when the elongate stoppers 40*b* are received with in the second portions 37*b*, the handle 15 is not rotatable about them. Thus, when the fastening members 40 are positioned in the first, upper, portions 37*a* within the slots 36, 38 the handle 15 is pivotal between the storage and use positions. Conversely, when the fastening members 40 are positioned in the second, lower, portions 37*b* within the slots 36, 38, the handle 15 is not pivotal and therefore substantially limits swaying of the housing 12 relative to the handle 15.

As should be recognized from FIGS. 8 and 9, the second portion 37*b* of the slots 36, 38 can only receive the elongate stoppers 40*b* when the handle 15 and fastening members 40 are pivoted relative to each other such that the elongate stopper 40*b* substantially align with the elongate second portions 37*b* of the slots 36, 38. That is, the elongate axis A-A of the elongate stopper 40*b* and the elongate axis B-B of the second portion 37*b* must substantially align. For example, from the position shown in FIG. 8, the handle 15 must be rotated counter-clockwise relative to the elongate stopper 40*b* to achieve the substantially aligned orientation shown in FIG. 9. In the illustrated embodiments, each elongate axis B-B of the second portions 37*b* is oriented along/parallel with the respective handle side arm 30, 32. The above-described alignment is therefore achieved when the handle 15 is pivoted to the upright or use position. In embodiments where the fastening members 40 are in fixed position on the housing 12, they are positioned so that the elongate axis A-A of the elongate stopper 40*b* is oriented substantially vertically. Thus, when the handle 15 is moved or pivoted to the use position, respective elongate stoppers 40*b* and second portions 37*b* align.

The handle lock is then activated when the handle 15 is pulled upwards, such that the weight of the tote 10, or the upward force on the handle 15, moves the arms 30, 32 relative to the fastening members 40 to position the members 40 into the second locked position within the respective slots 36, 38. In the illustrated embodiment, this relative upward movement of the handle 15 when in the use position causes the elongate stoppers 40*b* to engage into the second portions 37*b* of the slot, preventing relative pivoting of the handle 15 and fastening member 40, and thereby the housing 12. Locking of the handle 15 relative to the housing 12, thereby reducing swaying of the housing 12 relative to the handle 15, mitigates dislodging of contents from the housing 12. Generally, the weight of the tote mitigates accidental movement of the handle into the unlocked position. Unlocking of the handle 15 is achieved by manually pressing the handle 15 downwards relative to the housing 12, e.g., such as when the housing 12 is placed onto a surface, to, in turn, position the handle 15 back into the first, unlocked, position. In the illustrated embodiment, such movement of the handle 15 slides the second portion 37*b* of the slots 36, 38 away from the elongate stopper 40*b* so that it no longer engages the elongate stopper 40*b*, which is received in the first portion 37*a* of the slots 36, 38, permitting the handle 15 to pivot.

As should be understood by those of ordinary skill in the pertinent art, the handle mechanism can lock and/or pivoting/swaying of the housing 12 relative to the handle 15 can be reduced in numerous ways. For example, and without limitation, the tote 10 may include two pivotal handles rather than one. The two handles may be pivoted toward one another until the upper arms of the respective handles engage one another, e.g., at an approximately central point therebetween and an approximately central point of the housing 12. Each handle half prevents the other from pivoting further, thus keeping the handles and housing 12 in the same position relative to each other. Accordingly, the pivoting of the housing 12 relative to the handles is effectively eliminated.

When the lids 26, 28 are in in the closed position, and the handle 15 is in the storage position, the lids 26, 28 cover the handle 15, as shown in FIG. 4. The cover 14 is also configured to close while accommodating the handle 15 in the use or upright position. The lid 26 includes first and second slots or openings 42*a*, 44*a* extending from the edge 26*b*, and the lid 28 includes counterpart first and second slots 42*b* and 44*b* extending from the edge 28*b*. When the lids 26, 28 are both in the closed position, the first slots 42*a* and 42*b* together define an enclosed first slot 42, as shown best in FIG. 4. Likewise, when the lids 26, 28 are in the closed position, the slots 44*a* and 44*b* combine to define an enclosed second slot 44. The first and second slots 42 and 44 are positioned, sized and dimensioned so as to not engage the handle 15 when upright and to allow the first and second side arms 30, 32 of the handle 15 to extend therethrough. When the handle 15 is in the upright position, the lids 26, 28 can still pivot into the closed position, and the side arms 30 and 32 will extend from the respective slots 42 and 44. Thus, the tote 10 can be carried from the handle 15 while the cover 14 is closed. This helps prevent objects or liquids from spilling out of the storage area 12*a* when carrying the tote 10.

Though in the illustrated embodiment the storage area 12*a* is shown as a generally open area, the storage area 12*a* can be configured to accommodate commonly used tools and supplies for intended applications. For example, and without limitation, the storage area 12*a* can include pockets, cubbies, openings, receptacles, portions or inserts configured to receive saws, saw blades, drills, drill bits and/or other task specific tools and supplies. The housing 12 can also include portions, inserts, etc. configured to accommodate a plurality of general purpose tools and supplies. For example, and without limitation, the housing 12 can include ones for receiving, hammers, screw drivers, pliers, scissors, tape measures, screws, nails, etc. The pockets, receptacles, portions, inserts, etc. can be placed or secured into the storage area 12*a*, either removably or non-removably. Alternatively they can be integrally formed with the housing 12, such as, for example, in embodiments where the housing 12 is injection molded, they can be molded as part of the housing 12 itself.

Figure 5:
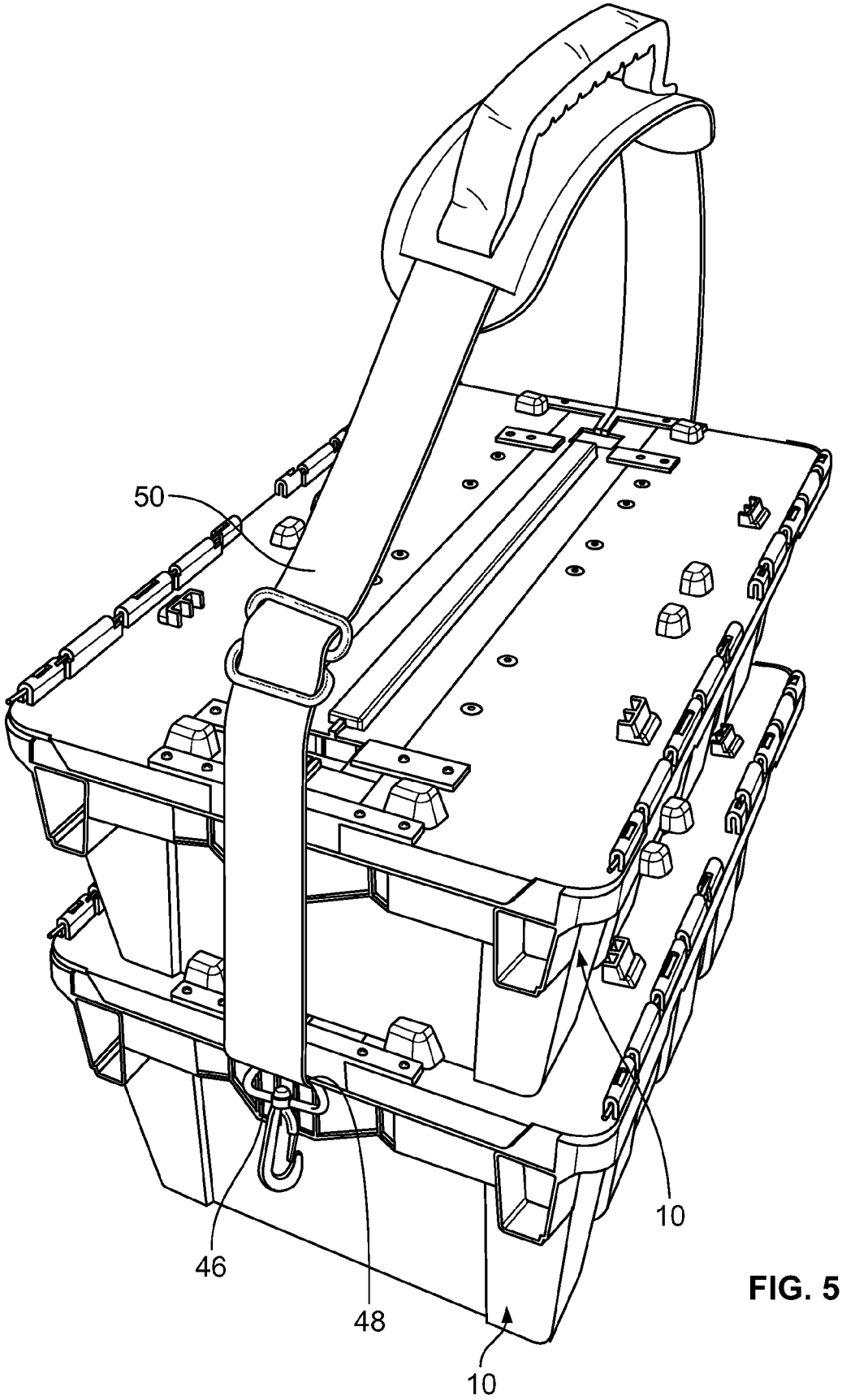
FIG. 5 is a perspective view of two devices of FIG. 1 stacked on top of one another with a shoulder strap attached to the lowermost device.

In some embodiments, the tote 10 includes a shoulder strap 50. As shown in the embodiment of FIG. 5, the first and second sidewalls 22, 24 include respective projections 46 projecting from the external surface thereof, having slots or holes 48 therein configured as attachment anchors for the ends of a shoulder strap 50. Thus, the tote 10 can thus alternatively be carried by the shoulder strap, either by hand or by placing the strap on a user's shoulder to carry the tote 10 in a "hands-free" manner. As shown, the shoulder strap 50 is removable. In other embodiments, the shoulder strap 50 is permanently attached to the housing 12.

Figure 6:
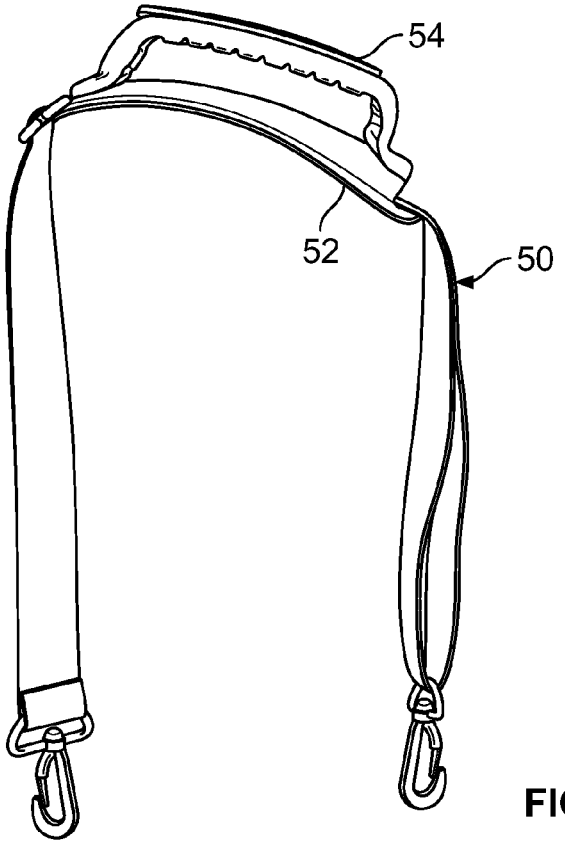
FIG. 6 is a view of a shoulder strap having both a cushioned shoulder portion and a handle attached thereto.

As should be understood by those of ordinary skill in the pertinent art, a shoulder strap can include any on numerous different connectors at the ends thereof for attaching and/or latching onto the slots 48. Likewise, the projections 46 may take the form of any of numerous different connection anchors configured to provide an anchor point for the connecting ends of the shoulder strap. As also should be understood by those of ordinary skill in the pertinent art, conventional shoulder straps, such as length-adjustable and cushioned shoulder straps, may be utilized. In some embodiments, a shoulder strap 50 as shown in FIG. 6 can be used. The shoulder strap 50 includes both a cushioned portion 52 for placement on a user's shoulder when carried "hands-free" as well as a handle 54 attached thereto. A user can carry the tote 10 with his hands by the handle 54, such as, for example, when more than one tote 10 is stacked on top of the other, as shown in FIG. 5.

One advantage associated with the above-described tote configuration is the presence of the cover/lid 14. The cover 14 aids in protecting the tools and/or supplies stored within the housing 12 from the external environment and weather conditions. Additionally, the cover 15 aids in preventing tools and/or supplies stored within the housing 12 from falling out. Another advantage associated with the above described tote configuration is the movable handle 15 between storage and use positions. When the handle 15 is in the storage position, and the cover 14 is closed, the tote 10 defines a substantially flat top surface. Thus, a tool, object, or another tote 10 can be stacked on top without interference from the handle 15. This aids in compact storage and transport of multiple totes 10 as shown in FIG. 5.

As shown in FIGS. 3-5, the cover 14 includes tabs 14*a* projecting from the lids 26, 28. As mentioned above, the base 16 of each tote 10 defines a slightly smaller perimeter than the upper rim 13 thereof. Therefore, the tabs 14*a* are positioned inwardly from the upper rim 13 on the lids 26, 28 in order to fittingly engage the bottom portions of the sidewalls of another tote 10 stacked thereon. The tabs 14*a* stabilize the stacked tote 10 and assist in preventing relative lateral movement between the totes during transport. Further, the tabs 14*a* keep stacked totes centered on top of one another to help preventing tipping of a stack of totes. Yet another advantage associated with the above-described tote configuration is the shoulder strap 50, which allows for "hands-free" carrying of the tote 10. Further, more than one tote 10 can be carried at a time when a strap is connected to a lowermost tote 10, and other totes are stacked thereon.

As may be recognized by those of ordinary skill in the pertinent art based on the teachings herein, numerous changes and modifications can be made to the above-described and other embodiments of the present invention without departing from the scope of the invention as defined in the appended claims. Accordingly, this detailed description of embodiments is to be taken in an illustrative, as opposed to a limiting sense.

What is claimed is:

1. A device for storage and transfer of tools and supplies, comprising:

a housing defining a storage area therein and configured to receive a plurality of tools and supplies, wherein the housing comprises a fastening member comprising a stopper, and wherein the stopper has an elongated shape;

a handle pivotally attached to the housing via the fastening member, wherein the handle defines a slot comprising a first portion located at a first end of the slot and a second portion located at a second end of the slot, wherein the handle is pivotable between a storage position located within the housing above the storage area and a use position projecting from the housing for carrying the device thereby, wherein the handle is movable between an unlocked position in which the handle and the housing are pivotable relative to each other and a locked position in which the handle and the housing are substantially not pivotable relative to each other, wherein the stopper is located in the first portion of the slot when the handle is in the unlocked position, wherein the stopper is located in the second portion of the slot when the handle is in the locked position, wherein the first portion of the slot has a circular shape configured to allow the handle to rotate about the stopper, and wherein the second portion of the slot has an elongated shape configured to substantially prevent the handle from rotating about the stopper; and a cover pivotally attached to the housing, wherein the cover is pivotable between a closed position covering the storage area and an open position at least partially exposing and permitting access to the storage area, and wherein the cover is pivotable between the closed position and the open position when the handle is in the storage position and when the handle is in the use position.

2. A device as defined in claim 1, further comprising a shoulder strap releasably attached to the housing.

3. A device as defined in claim 1, wherein the cover comprises a first lid pivotally attached to a first wall of the housing, and a second counterpart lid pivotally attached to a second wall of the housing opposing the first wall, and wherein the first lid and the second lid are independently pivotable between the closed position and the open position.

4. A device as defined in claim 3, wherein the first lid comprises a strip configured to extend over at least a portion of the second lid and to cover a seam defined by the first lid and the second lid when the first lid and the second lid are in the closed position.

5. A device as defined in claim 4, wherein the second lid comprises a lip, wherein the strip defines a channel along an underside thereof configured to at least partially receive the lip therein when the first lid and the second lid are in the closed position, and wherein the strip and the lip are configured to provide support to the cover when the first lid and the second lid are in the closed position.

6. A device as defined in claim 1, wherein the cover covers the handle when the handle is in the storage position and the cover is in the closed position.

7. A device as defined in claim 1, wherein the handle is movable between the unlocked position and the locked position only when the handle is in the use position.

8. A device as defined in claim 1, wherein the handle is slidably attached to the housing via the fastening member, and wherein the handle is slidable between the unlocked position and the locked position.

9. A device as defined in claim 8, wherein the slot is defined in a side arm of the handle, wherein the fastening member extends through the slot, and wherein the side arm and the fastening member are slidable relative to each other between the unlocked position and the locked position.

10. A device as defined in claim 1, wherein the housing comprises a base and a wall defining the storage area, wherein a lower end of the wall extends upwardly from the base at an obtuse angle, and wherein an upper end of the wall defines a rim defining an opening to the storage area permitting access to the storage area.

11. A device as defined in claim 10, wherein the rim defines a perimeter that is larger than a perimeter of the base.

12. A device as defined in claim 10, wherein the cover engages the rim and is at least partially supported thereby when the cover is in the closed position.

13. A device as defined in claim 12, wherein the cover rests substantially flat on the rim when the cover is in the closed position.

14. A device as defined in claim 10, wherein the wall comprises a projection extending inwardly into the storage area from an interior surface of the wall, the projection located such that the handle engages the projection when the handle is in the storage position.

15. A device as defined in claim 14, wherein the projection is spaced from the upper end of the wall toward the lower end of the wall a sufficient distance such that the handle, in the storage position, at least one of (i) does not project past the rim; and (ii) is located entirely within the housing.

16. A device as defined in claim 10, wherein the cover comprises a plurality of tabs spaced inwardly from the rim when the cover is in the closed position, the plurality of tabs defining a shape substantially corresponding to a shape of the base.

17. A device as defined in claim 16, further comprising a second device comprising a bottom portion substantially corresponding to the shape of the base, the bottom portion engaging the cover inwardly of the plurality of tabs.

18. A device as defined in claim 1, wherein the cover defines a slot therein configured to permit the handle to extend therethrough when the cover is in the closed position and the handle is in the use position.

19. A device as defined in claim 1, wherein the cover defines a substantially flat upper surface of the device when the cover is in the closed position.

* * * * *